United States Patent [19]

Kitamura et al.

[11] Patent Number: 5,063,973

[45] Date of Patent: Nov. 12, 1991

[54] REED DENT WITH OPTICAL WEFT DETECTING DEVICE

[75] Inventors: Satoru Kitamura, Matsutou; Shigehira Minami; Yoshihiko Habu, both of Kanazawa; Sigeru Iuchi, Kawasaki; Yoshikazu Fujinaga, Toyohashi, all of Japan

[73] Assignees: Kabushiki Gaisha Ishikawa Seisakusho, Ltd., Kanazawa; Mitsubishi Rayon Co., Ltd., Tokyo, both of Japan

[21] Appl. No.: 489,673

[22] Filed: Mar. 7, 1990

[30] Foreign Application Priority Data

Mar. 8, 1989 [JP] Japan ..... 1-056659

[51] Int. Cl.[5] ..... D03D 51/34

[52] U.S. Cl. ..... 139/370.2

[58] Field of Search ..... 139/370.2, 370.1; 250/561, 571

[56] References Cited

U.S. PATENT DOCUMENTS

| | | | |
|---|---|---|---|
| 4,085,777 | 4/1978 | Dadak et al. | 139/370.2 |
| 4,398,570 | 8/1983 | Suzuki et al. | 139/370.2 |
| 4,592,394 | 6/1986 | Bobbola . | |
| 4,738,284 | 4/1988 | Ishikawa et al. . | |
| 4,805,671 | 2/1989 | Castellini et al. | 139/370.2 |

FOREIGN PATENT DOCUMENTS

| | | |
|---|---|---|
| 56-138886 | 10/1981 | Japan . |
| 59-163448 | 9/1984 | Japan . |
| 60-104560 | 6/1985 | Japan . |

*Primary Examiner*—Andrew M. Falik

*Attorney, Agent, or Firm*—Burns, Doane, Swecker & Mathis

[57] ABSTRACT

In a weft detecting device, optical fiber bundles, lenses, a light emitting module, a light receiving module, and an amplifier are integrated in a thin detecting sensor body having substantially the same shape of that of reed dent so that the device can be fitted in the narrow space between the reed dents of an air jet loom.

9 Claims, 4 Drawing Sheets

REED DENT WITH OPTICAL WEFT DETECTING DEVICE

BACKGROUND OF THE INVENTION

1. Technical Field of the Invention

The present invention relates to a weft detecting device used in a loom such as an air jet loom, and particularly to a weft detecting device which detects a weft passing through a weft guide groove provided in a reed by a transmitted light.

2. Description of the Related Arts

Usually, a reed of an air jet loom comprises a number of dents of reed held parallel between an upper frame and a lower frame with each dent of reed having a shape projecting forwardly of the loom and a recess provided at the summit of the projection. The reed has a weft guide groove (weft flying path) formed of a number of recesses of the dents of reed. A weft is thrown in the loom by means of an air jet from a main air nozzle provided on the weft throwing-in (weft inlet) side of the loom and auxiliary air nozzle provided at a side of an the weft guide groove. And whether the weft has been regularly inserted or not is detected by a weft detecting device provided on the side opposite to the weft inlet side of the loom.

Various kinds of weft detecting device have been proposed. However, no weft detecting device having a sufficient detecting ability and being reliable and inexpensive has been provided yet.

For example, in Japanese Published Unexamined Patent Application No. 163448/1984, a weft detecting device is disclosed in which a plurality of light emitting optical fibers and a plurality of light receiving optical fibers are respectively bundled, and these bundles of optical fibers are inserted between dents of reed so as to be put in a weft guide groove provided in a reed from behind at a position near the limit of the weft reaching position of the weft guide groove on the side opposite to the weft inlet side. This weft detecting device is a reflecting weft detecting device in which a weft is detected by using an effect that a light emitted from the light emitting optical fibers is reflected by the weft and is incident onto the light receiving optical fiber.

However, in this reflecting weft detecting device in which a weft is detected by reflection of light (disclosed in Published Unexamined Patent Application No. 163448/1984), light is only a little reflected by some kinds of wefts, for example, a black and a transparent wefts, and therefore, the weft detecting sensibility of this device is low and the device as a whole is not so reliable.

Further, a weft detecting device is disclosed in Japanese Published Unexamined Utility Model Application No. 138886/1981 in which weft detecting means (a light emitter and a light receiver) are attached to a pair of (a right and a left) projections of a weft detecting member adapted to be inserted between dents of reed, and a flexible printed wire plate is adhered to one side surface of the weft detecting member, so that the weft detecting means are electrically connected through the flexible printed wire plate to an outer control section.

However, in this device disclosed in Japanese Published Unexamined Utility Model Application No. 138886/1981, since the light emitting element and the light receiving element are provided directly in the detecting section, the device cannot be made thin and therefore cannot be inserted between dents of reed.

Further, because the size and shape of the elements are limited by the size and shape of the reed, the ability of the elements is limited. Consequently, it is difficult to accurately detect every change of the light amount caused when a thin weft passes throughout the whole of the weft passing region. Further, the reed moves back and forth during the weft throwing-in operation thereby pushing the weft in a space between the arranged warps. In an air jet loom, such a movement of the reed is made at a high speed, such as more than 600 times/min. However, in the prior art, no weft detecting device has yet been developed which has sufficient mechanical strength to withstand such shocks.

In a weft detecting device disclosed in Japanese Published Unexamined Patent Application No. 10456/1985, two extremely thin total reflection optical prisms are inserted between dents of reed so that lights cross the weft path between the prisms, whereby a weft is detected. The weft detecting device disclosed in Published Unexamined Patent Application No. 104560/1985 is a device for detecting a weft by a transmitted light in which optical elements comprising two prisms are provided in the weft guide groove and a weft is detected based on a change of light amount caused by the presence and the absence of the weft. Therefore, this device has no disadvantages of a weft detecting device of the reflection type. However, since the two prisms are not positioned in one united body and the light amount transmitted between prisms is changed by the shaking of the prisms during the operation of the loom, thereby causing noise, and only a low percentage of the light amount of the prisms is effectively used, the weft detecting sensibility of this device is low. Further, since the prisms are expensive, the manufacturing cost of the device becomes high.

As abovementioned, in the prior art, no weft detecting device has been developed which has a sufficient detecting ability and reliability, and is easy to treat and inexpensive. The reasons are that the size and shape of the detecting section are limited by the size and shape of a reed, and the detecting section hardly withstands the shocks more than 600 times/min. as abovementioned, and further, it is hard to prevent the adverse influence of dust upon the device when the operating loom is full of fibrous dust.

SUMMARY OF THE INVENTION

The present invention has been made based on the abovementioned background. An object of the present invention is to provide a weft detecting device which is capable of executing reliable weft detection, being inserted in a narrow space between dents of reed, maintaining the sufficient detecting ability even when it is attached to a reed, being violently shaken in operation, being designed to avoid the adverse affects from dust, and is easy to treat and inexpensive.

In order to achieve the abovementioned object, the inventor has studied in many respects, and found the following facts. The present invention has been made based on these facts.

(1) If a weft detecting device can be so formed as to have a similar shape the shape of a dent reed and can be fitted in a narrow space between dents of reed, the device can be protected from dust for the reasons mentioned below.

(2) If optical fibers are used in the light emitting and the light receiving sections, a thin weft detecting device capable of being fitted in a narrow space between dents of reed and having excellent detecting ability and shakeproof ability can be obtained.

(3) If the optical fiber bundles, a light emitting module, a light receiving module and the like are integrated in a sensor body having a shape similar to that of a dent of reed, it is effective for achieving the abovementioned object.

(4) If lenses are attached to the light emitting and light receiving end faces of the optical fibers, the exposed end faces of the optical fibers are more effectively protected from dust, and prevented from being damaged at the time of cleaning. By using convex lenses, light is focused and thereby the weft detecting sensibility becomes higher.

(5) If flat lenses are used, the abovementioned effects except the light focusing effect can be also obtained.

The objects and features of the present invention will become apparent from the following description given with reference to the appended drawings.

DETAILED DESCRIPTION OF THE PREFERRED EMBODIMENTS

Now, embodiments of the present invention will be described in the following with reference to the appended drawings.

Figure 1:
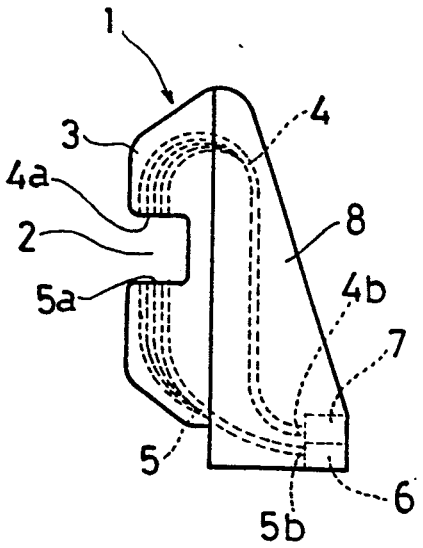
FIG. 1 is a schematical structural view of an embodiment of a weft detecting device according to the present invention.

The functions of a weft detecting device according to the present invention will be described in the following with reference to FIG. 1 showing a weft detecting device according to the present invention.

As seen in FIG. 1, a weft detecting device 1 comprises a thin plate shaped sensor body 3 having a recess 2 substantially in the same shape with the shape of a dent of reed and especially with the shape of a weft guide groove, a light emitting optical fiber bundle 4 and a light receiving optical fiber bundle 5, the light emitting ends 4*a* of the light emitting optical fibers and the light receiving ends 5*a* of the light receiving optical fibers being arranged in a line or lines on the end faces of the recess 2 respectively, a light receiving module 6 connected to a light outlet end 5*b* of the light receiving optical fiber bundle 5, a light emitting module 7 connected to a light inlet end 4*b* of the light emitting optical fiber bundle 4, and a support member 8.

The support member 8 in a weft detecting device according to the present invention intergrates the thin plate shaped sensor body 3, the two optical fiber bundles 4, 5, the light emitting module 6 and the light receiving module 7. The optical fiber bundles 4, 5 are fixed to the support member 8 during the time of use, fitting, detaching and maintenance.

In an air jet loom, the weft is flown on a transporting medium such as air from the weft throwing-in side along the weft guide groove, whereby the weft is inserted. By this weft insertion, the weft reaches the position of the weft detecting device provided on the terminal side of the weft insertion. When the weft reaches there, it is cut at its end on the weft throwing-in side, and a next weft is thrown in.

According to an electrical signal outputted from an outer control circuit (not shown), the light emitting module 7 transmits a detecting light through the light emitting optical fiber bundle 4 to the light emitting end 4*a*. The ends of the light emitting optical fibers are arranged in a line or lines.

The transmitted detecting light passes through the space in the recess (the weft guide groove) 2 and reaches the light receiving end 5*a*. The ends of the light receiving optical fibers are arranged in a line or lines, and the light receiving end 5*a* is opposed to the light emitting ends 4*a*. At this time, since the recess 2 has substantially the same shape with the shape of a portion of a dent of reed corresponding to the weft guide groove, turbulence of the air jet does not occur in the internal space of the weft guide groove and waste thread is prevented from collecting in the recess 2. A weft passing through a detecting region in the recess 2 intercepts the detecting light emitted from the optical fibers, and thereby the light receiving amount is caused to change from the amount at the time when the detecting light is not intercepted. A light including a weft detecting data is transmitted from the light receiving end 5*a* through the light receiving optical fiber bundle 5 to the light receiving module 6.

In the light receiving module 6, the optical data signal is converted into an electric data signal, and it is outputted to an outer control circuit (not shown).

The signal including the weft detecting data is processed in the outer control circuit.

In a weft detecting device according to the present invention, the optical fiber bundles are fixedly disposed in the thin plate shaped sensor body 3 and the support member 8, and the light emitting and light receiving modules 6, 7 are intregrated with the sensor body 3 and the support member 8. Therefore, even when the weft detecting device is attached to a reed and violently shaken repeatedly, the optical fibers are not bent in different ways by that shaking, so that a stabilized amount of light can always be emitted and received, and the sensor can sufficiently detect even a feeble change of the transmitted light amount caused by the presence of a thin weft.

EMBODIMENT 1

A weft detecting device according to the present invention will be described in detail by way of an embodiment. However, the scope of the present invention is not limited to this embodiment unless it contradicts the objects of the present invention.

Figure 2:
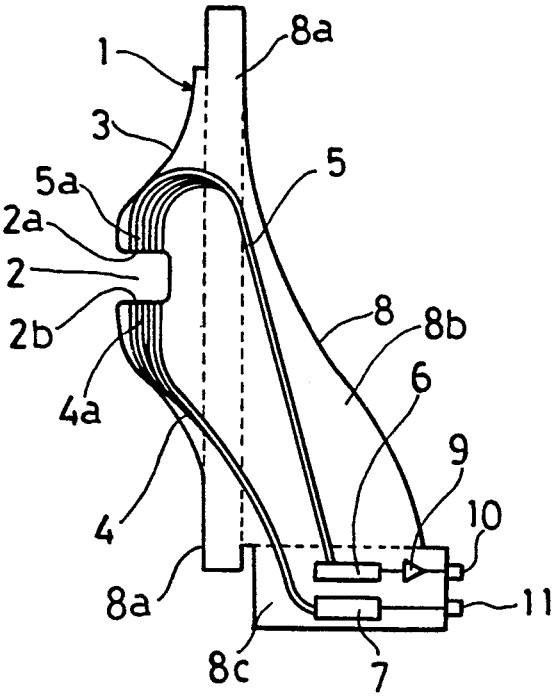
FIG. 2 is a schematical sectional view of the embodiment of a weft detecting device according to the present invention.
Figure 3:
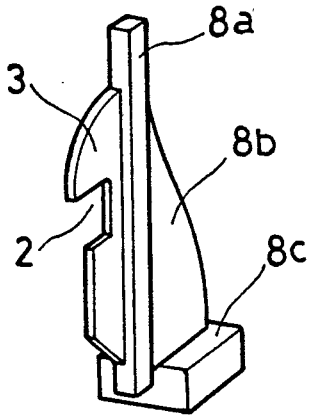
FIG. 3 is a perspective view of the weft detecting device of a FIG. 2.

FIGS. 2 and 3 schematically show the first embodiment of a weft detecting device according to the present invention.

The weft detecting device 1 of this embodiment comprises a thin plate shaped sensor body 3, a light emitting optical fiber bundle 4, a light receiving optical fiber bundle 5, a light receiving module 6, a light emitting module 7, a support member 8, an amplifier 9, an output terminal 10 and an input terminal 11.

In this embodiment, the thin plate shaped sensor body 3 has a shape similar to the shape of a dent of reed of an air jet loom (not shown), and is thin enough to be inserted in a space between dents of reed. A reed has a recess in the dents of reed so as to form a weft guide groove, and the thin plate shaped sensor body 3 according to the present invention has a recess 2 substantially in the same shape with that of the recess of the dents of reed. The recess 2 has an upper end face 2*a* and a lower end face 2*b* opposed to each other with a space of the weft guide groove therebetween. The sensor body 3 may be formed of any material if it can fix and protect the optical fiber bundle 4, 5 contained in the sensor body 3, but preferably it is formed of a material having a sufficient mechanical strength such as a metal, a plastic material, a compound material or the like.

In this embodiment, a light emitting end 4*a* in which the end faces of the light emitting optical fibers 4 are arranged in a line or lines is provided vertically to the lower end face 2*b*, while a light receiving end 5*a* in which the end faces of the light receiving optical fibers 5 are arranged in a line or lines is provided vertically with respect to the upper end face 2*a*. The optical fiber bundles 4, 5 according to the present invention may be organic or inorganic if they can transmit light and have the abovementioned functions. However, preferably they are plastic fibers which are excellent in respect of flexibility, easy to process and use, and inexpensive.

Figure 5:
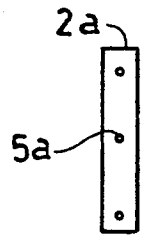
FIG. 5 is partly enlarged views showing examples of end faces of an optical fiber bundle used in a weft detecting device according to the present invention.
Figure 5:
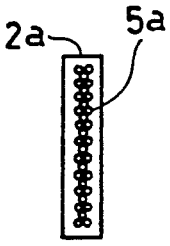
Figure 5:
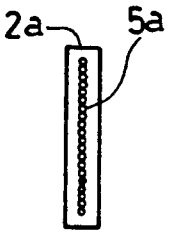

The optical fiber bundle according to the present invention comprises a plurality of optical fibers. The way of arranging the optical fibers on the end faces 2*a*, 2*b* can be suitably selected according to purposes, for example, as shown in FIGS. 5(*a*), 5(*b*) and 5(*c*). However, in order to increase the sensitivity of the sensor, preferably a number of optical fibers are arranged in close contact with one another in a line or in a plurality of lines as shown in FIGS. 5(*b*) and 5(*c*).

At the end opposite to the light receiving end 5*a* of the light receiving optical fiber bundle 5, namely, the light outlet end of the light receiving optical fiber bundle 5, an input of the light receiving module 6 is provided, while an output of the light receiving module 6 is transmitted through the amplifier 9 such as a preamplifier to the output terminal 10. The light receiving module 6 comprises a light receiving element such as a photodiode, a connector for connecting the light receiving element with the optical fibers, and the like.

On the other hand, the end opposite to the light emitting end 4*a* of the light emitting optical fiber bundle 4, namely, at the light inlet end of the light emitting optical fiber bundle 4, a light emitting module 7 is provided which is connected to the input terminal 11. The light emitting module 7 comprises a light emitting element such as an LED, a driving circuit for driving the LED, a connector for connecting the LED with the optical fibers.

Figure 6:
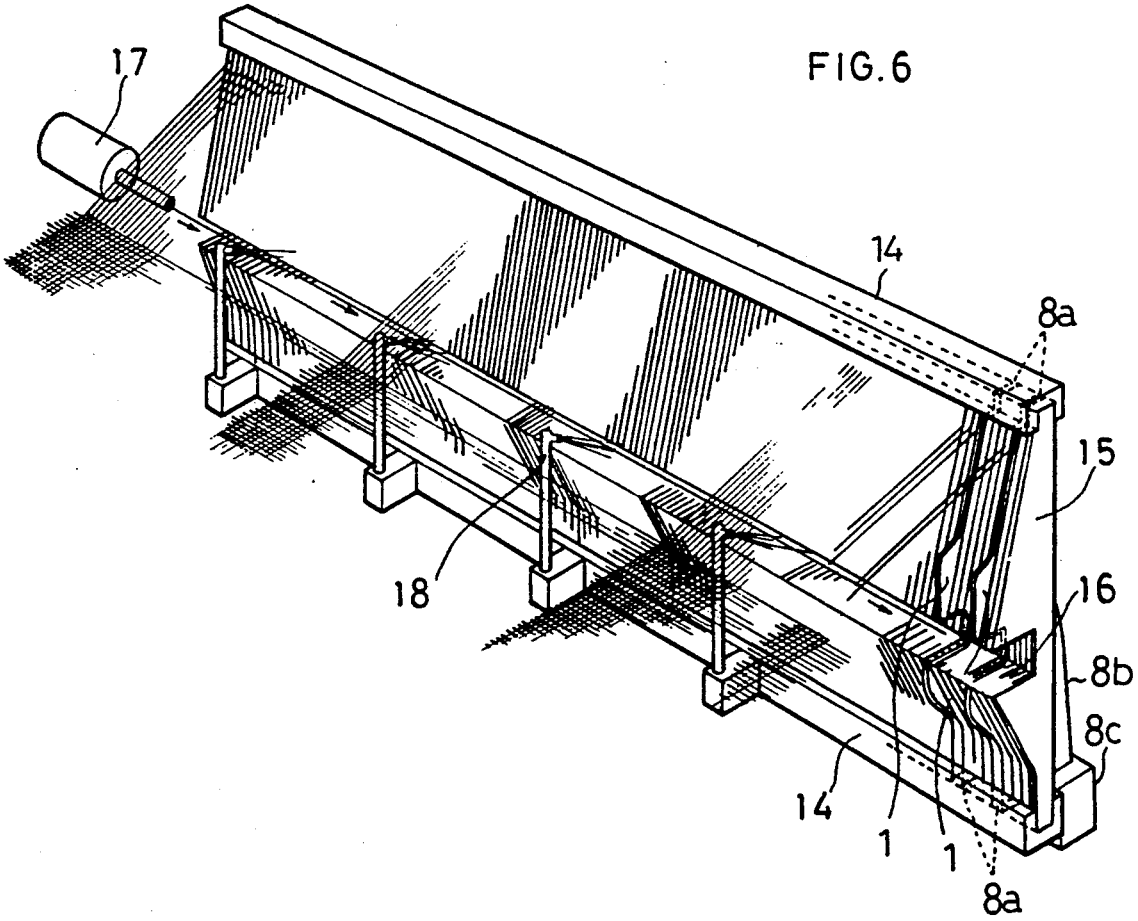
FIG. 6 is a perspective view of an embodiment of a weft detecting device according to the present invention which is inserted between dents of reed.

The support member 8 in this embodiment comprises a support column 8*a* which is adapted to be removably inserted in frames 14 (as shown in FIG. 6) of a reed and which holds the sensor body 3. The support member 8 also includes a support box 8*c* for containing the light receiving module 6, the light emitting module 7 and the amplifier 9 therein, and a support plate 8*b* for passing the optical fiber bundle 4, 5 and holding the support column 8*a* and the support box 8*c*.

The support member 8 of this embodiment comprising the abovementioned parts integrates the sensor body 3, the light emitting optical fiber bundle 4, the light receiving optical fiber bundle 5, the light receiving module 6, the light emitting module 7 and the amplifier 9. The word "integrate" in this specification means that each of the integrated parts are fixed and disposed in the predetermined positions all the time when the weft detecting device is used, attached and detached. Accordingly, the optical fiber bundles are prevented from being bent and exposed and therefore prevented from being degraded, so that the light amount required for the weft detection can be maintained at a high level and a high detecting precision can be kept. Further, even in a condition full of waste thread when the loom is in operation, photoelectric converting elements can be kept from dust and waste thread.

Now, the operation and functions of a weft detecting device of this embodiment will be described in the following.

Firstly, the weft detecting device of this embodiment is mounted on a reed. FIG. 6 shows the weft detecting device 1 in a state of being inserted between the dents of the reed 15. In this inserted state, the recess 2 of the weft detecting device 1 corresponds to the weft guide groove 16 formed of a recess of the dents of the reed 15 and the support column 8*a* is removably inserted into the frames 14 as generally shown in FIG. 6. In FIG. 6, numeral 17 indicates a main air nozzle and numeral 18 indicates an auxiliary air nozzle.

In an air jet loom, a weft flies on compressed air as a transporting medium from the weft inlet side along the weft guide groove, whereby the weft is inserted. By this insertion of the weft, the leading end of the weft reaches the position of the weft detecting device 1 which is disposed on the side opposite to the weft inlet side.

An electric signal is transmitted from an outer control circuit (not shown) through an input terminal 11. According to this signal, the light emitting module 7 transmits light through the light emitting optical fiber bundle 4 to the light emitting end 4*a* of the light emitting optical fiber bundle 4. Light emitted from the plurality of the light emitting ends 4*a* arranged in the end face of the optical fiber bundle 4 passes through substantially the whole region of the space in the recess (the weft guide groove) 2, and reaches the light receiving end 5*a* opposed to the light emitting end 4*a*. At this time, since the recess 2 has substantially the same shape with the shape of portion of the dents of reed corresponding to the weft guide groove, no air turbulence occurs in the internal space of the weft guide groove and waste thread are prevented from collecting in the recess 2. A weft passing through the weft detecting region in the recess 2 intercepts the detecting light, and the received light amount is caused to change from the amount measured at the time when the detecting light is not intercepted by the weft. The presence or absence of such a change of the received light amount provides the weft detecting data. The light including the weft detecting data goes from the light receiving end 5*a* through the light receiving optical fiber bundle 5 to reach the light receiving module 6.

In the light receiving module 6, the optical data signal is converted into an electric data signal. The electric data signal is amplified by the amplifier 9 and then outputted through the output terminal to the outer control circuit.

The signal including the weft detecting data is processed in the outer control circuit, so that the loom is operated according to the weft detecting data.

According to the present invention, one weft detecting device may be provided on the side opposite to the weft inlet side as described in the abovementioned embodiment. However, the present invention is not limited to this embodiment but can be applied in various ways. For example, at least two weft detecting devices may be provided in a series on the side opposite to the weft inlet side. In this embodiment, the first weft detecting device is provided at a limit position which a normally thrown-in weft reaches, and the second weft detecting device can be provided at a position beyond the abovementioned limit position. In this embodiment, when only the first weft detecting device detects the weft, it can be judged that the weft has been regularly inserted. And when both of the first and second weft detecting devices detect the weft, it can be judged that the weft has been cut. Further, when neither the first nor the second weft detecting device detects the weft, it can be judged that the weft has stopped along the way.

EMBODIMENT 2

Figure 4:
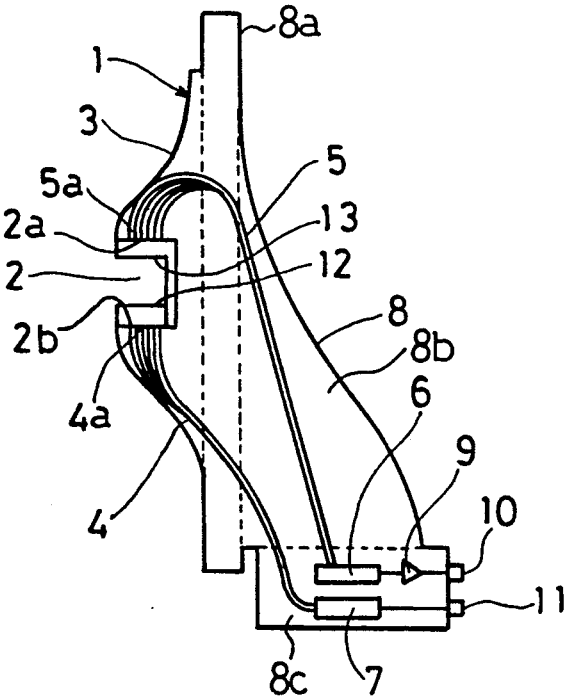
FIG. 4 is a schematical structural view of an embodiment of a weft detecting device according to the present invention in which lenses are attached to end faces of optical fiber bundles.

The second embodiment of a weft detecting device according to the present invention is schematically shown in FIG. 4.

A weft detecting device of the second embodiment shown in FIG. 4 has the same structure, functions and effects with those of the abovementioned first embodiment shown in FIG. 2 except that it has a lens 12 attached to the light emitting end 4*a* and another lens 13 attached to the light receiving end 5*a*. Therefore, only the functions and effects of the lens 12, 13 will be described in the following.

In the first embodiment, at the light emitting ends and the light receiving ends of the optical fibers, the end portions of the optical fibers are exposed or coated with a resin. Such light emitting and receiving end faces are not smooth and waste thread and pieces of dried starch used for weaving are apt to attach these end faces. Further, when the waste thread and pieces of dried starch used for weaving are cleaned away, sometimes the optical fiber ends are degraded or the resin becomes discolored.

By attaching lenses 12, 13 to the light emitting and receiving end faces, these faces become smooth. Therefore, the waste thread and the pieces of dried starch used for weaving hardly attach to the end faces, and further, if attached, they are easily and automatically removed away from the end faces by the air jet used for passing the weft. Further, as abovementioned, when the exposed or only resin-coated optical fiber end faces are repeatedly cleaned, the end faces are degraded and the coated resin becomes discolored, whereby the weft detecting sensibility of the optical fiber ends is disadvantageously lowered. However, the weft detecting sensibility of the optical fiber ends to which the lenses are attached is not lowered by cleaning.

Figure 7:
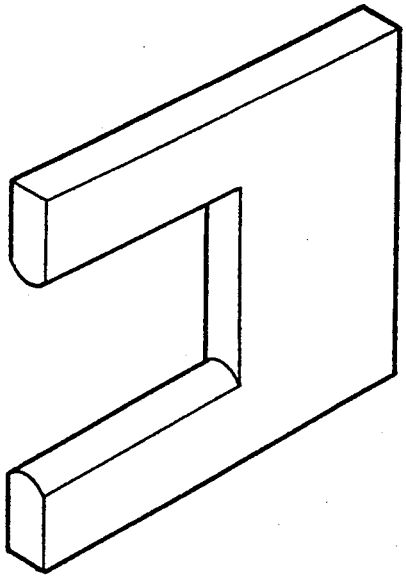
FIG. 7 is a perspective view of an embodiment of a convex lens according to the present invention.
Figure 8:
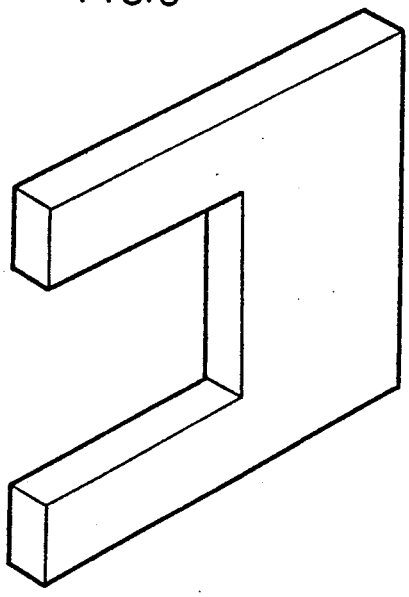
FIG. 8 is a perspective view of an embodiment of a flat lens according to the present invention.

The lenses 12, 13 may be flat or convex lenses. FIG. 7 shows the convex lenses 12, 13 while FIG. 8 illustrates the flat lenses 12, 13. Also, FIG. 4 shows the lenses 12, 13 which are arranged in the weft detecting device. When flat lenses are used, the abovementioned effects can be obtained. When convex lenses are used, they can focus the light. Therefore, in this case, in addition to the abovementioned effects of flat lenses, a high weft detecting sensibility can be obtained, so that even with a thin weft, a sufficient signal to noise ratio (S/N ratio) can be obtained and a stabilized weft detecting operation can be achieved.

Effects of the Invention

According to the present invention and in addition to the features discussed above, the following effects can be obtained.

Since the optical fiber bundles are integrated with the support member, they are fixed and protected by the support member at the time of use, attachment, detachment and maintenance. Consequently, even if the weft detecting device according to the present invention is attached to a reed of an air jet loom and violently shaken, the optical fiber bundles are prevented from being bent or exposed and therefore can be prevented from being degraded, and the amount of the detecting light being kept at a predetermined high level, so that a highly accurate weft detection can be achived. Further, since the light emitting and the light receiving modules are also protected by the support member, the photoelectric converting elements can be protected from dust and waste thread even in the condition when the loom is full of fibrous dust and the weft detection can be achieved still with a high accuracy.

Each of the end faces of the recess is provided with a number of light receiving ends or a number of light emitting ends of the optical fibers so that light can pass substantially the whole of the cross section of the weft guide groove. As a result, a weft passing any position in the weft guide groove can be precisely detected, thereby achieving a reliable weft detection.

Plastic optical fibers which are excellent in flexibility and processability, and easy to treat and inexpensive are used. Therefore, the device can be manufactured at a low cost and economically.

While this invention has been illustrated and described in accordance with several preferred embodiments, it is recongized that variations and changes may be made and equivalents employed herein without departing from the invention as set forth in the claims.

What is claimed is:

1. A weft detecting device in which a weft passing through a weft guide groove provided in a reed of a loom is detected by a light passing through the weft guide groove, comprising:

a thin plate shaped sensor body provided with a recess having substantially the same shape as the shape of a recess of a reed dent and adapted to be inserted between the dents, a light emitting optical fiber bundle and a light receiving optical fiber bundle each having a plurality of optical fibers, the optical fiber bundles being arranged in a line or lines respectively on a light emitting end and a light receiving end positioned on opposed end faces of the recess of the thin plate shaped sensor body with the weft guide groove being located therebetween, a light receiving module connected to a light outlet end of the light receiving optical fiber bundle, a light emitting module connected to a light inlet end of the light emitting optical fiber bundle, and a support member for integrating the thin plate shaped sensor body, the optical fiber bundles, the light emitting module and the light receiving module, said support member being removably inserted on a frame of the reed.

2. A weft detecting device as claimed in claim 1, wherein a number of light receiving ends and light emitting ends of optical fibers in the optical fiber bundles are arranged in close contact with one another in a line or lines on the opposing end faces of the recess respectively.

3. A weft detecting device as claimed in claim 2, wherein lenses are attached to the end faces of the recess respectively.

4. A weft detecting device as claimed in claim 3, wherein the lenses are flat lenses.

5. A weft detecting device as claimed in claim 1, wherein the optical fiber is a plastic optical fiber.

6. A weft detecting device as claimed in claim 5, wherein lenses are attached to opposing end faces of the recess respectively.

7. A weft detecting device as claimed in claim 6, wherein the lenses are flat lenses.

8. A weft detecting device as claimed in claim 1 wherein lenses are attached to opposing end faces of the recess respectively.

9. A weft detecting device as claimed in claim 8, wherein the lenses are flat lenses.

* * * * *